US005291995A

United States Patent [19]

von Agris et al.

[11] Patent Number: 5,291,995

[45] Date of Patent: Mar. 8, 1994

[54] PACK FOR NOTIONS AND THE LIKE

[75] Inventors: Rudolf von Agris, Aachen; Helmut Schiffer, Stolberg; Lutz Mantsch, Aldenhoven; Rolf Schumacher, Stolberg, all of Fed. Rep. of Germany

[73] Assignee: William Prym-Werke GmbH & Co. KG, Stolberg, Fed. Rep. of Germany

[21] Appl. No.: 903,711

[22] Filed: Jun. 24, 1992

[30] Foreign Application Priority Data

Jul. 24, 1991 [DE] Fed. Rep. of Germany ... 9109126[U]
Jan. 18, 1992 [DE] Fed. Rep. of Germany ..... 4201236

[51] Int. Cl.[5] ..... B65D 5/22; B65D 73/00

[52] U.S. Cl. ..... 206/336; 206/348; 206/380; 206/467

[58] Field of Search ..... 206/461, 464, 467, 468, 206/469, 470, 336, 348, 380, 52.6, 524.1, 806

[56] References Cited

U.S. PATENT DOCUMENTS

| | | | |
|---|---|---|---|
| 3,082,902 | 3/1963 | Kimbrough, Jr. | 206/468 X |
| 4,308,986 | 1/1982 | Parrilli | 206/470 |
| 4,408,693 | 10/1983 | Brewaeys et al. | 206/469 X |
| 4,445,622 | 5/1984 | Sideri | 206/469 X |
| 4,499,353 | 2/1985 | Shields | 206/470 |
| 4,899,882 | 2/1990 | Benner | 206/470 |
| 5,067,611 | 11/1991 | Hagmann | 206/383 |

*Primary Examiner*—Paul T. Sewell
*Assistant Examiner*—Jacob K. Ackun, Jr.
*Attorney, Agent, or Firm*—Darby & Darby

[57] ABSTRACT

A pack for notions and/or other relatively small commodities has a converted blank of cardboard or other degradable material and a light-transmitting plastic cover which is separably connected to a container of the converted blank. The converted blank further comprises a plate-like carrier having an opening so that it can be slipped onto a rail or an analogous support in a self-service store, in a workshop or at home. The plane of the carrier is located between the plane of a bottom wall of the container and the plane of a top wall of the cover. The sidewalls of the container forming part of the converted blank are removably confined between the lateral walls of the cover, and the top wall of the cover then overlies the open top of the container. The carrier can be separated from the container to reduce the space requirements of the remaining parts (container and cover) of the pack in a small area. The container can be withdrawn from and reinserted into the cover.

44 Claims, 6 Drawing Sheets

FIG. 1
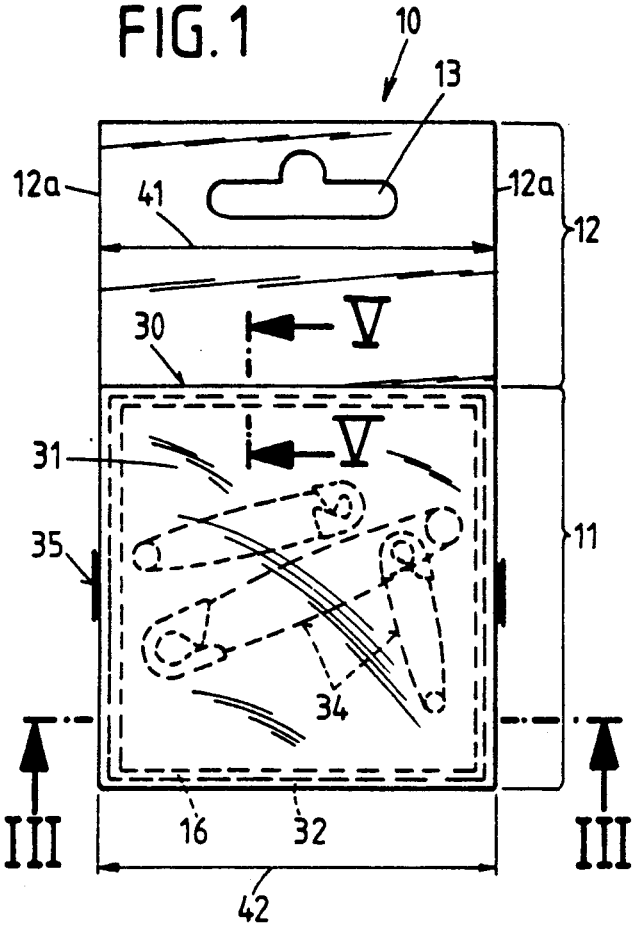
FIG. 2
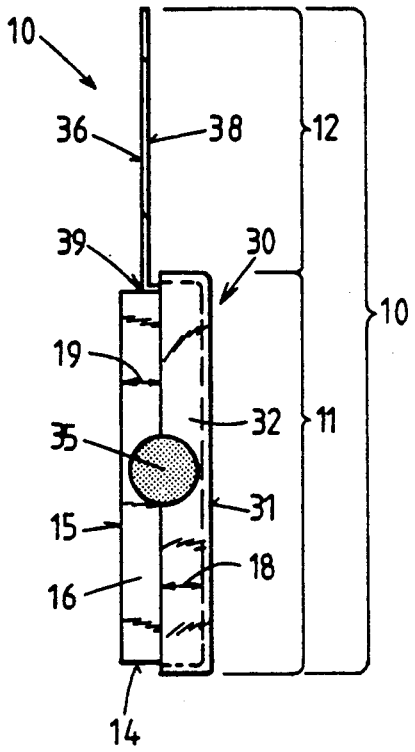
FIG. 3
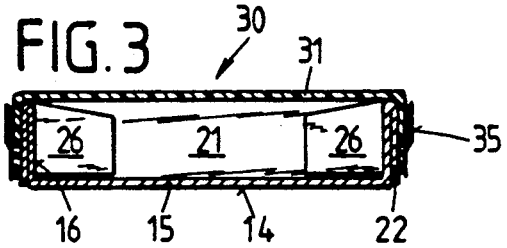
FIG. 4
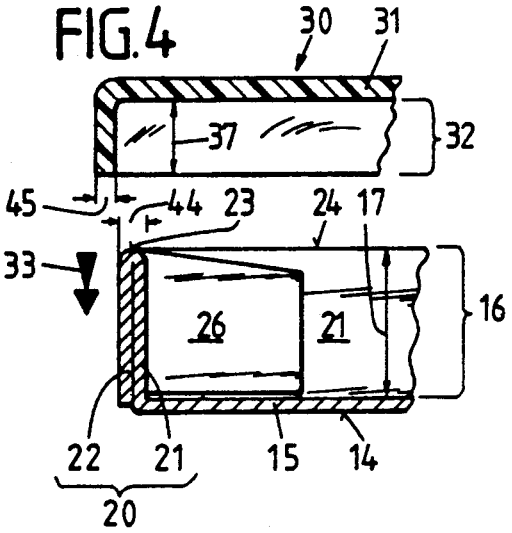
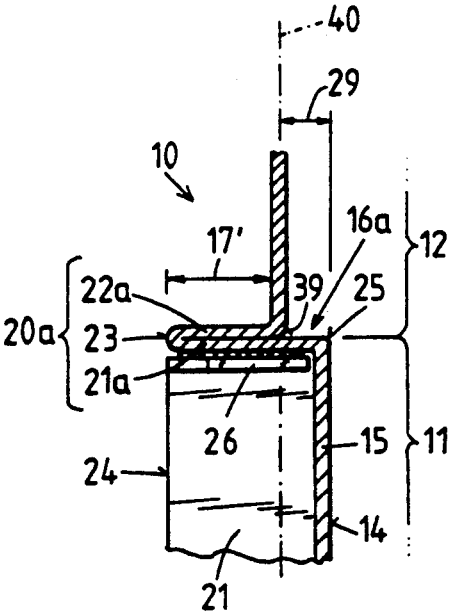
FIG. 5

FIG. 8
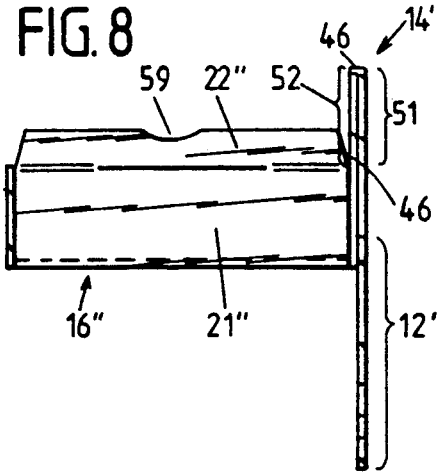
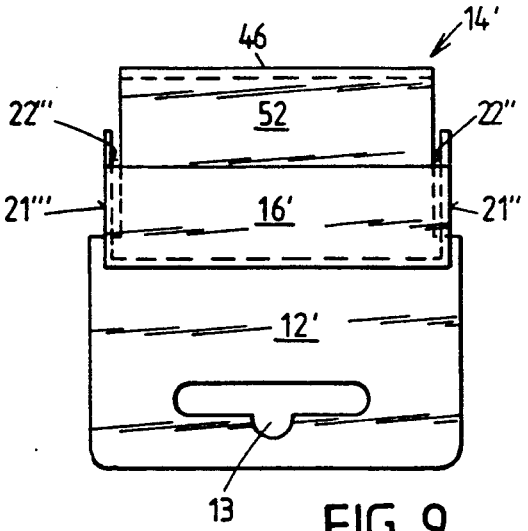
FIG. 9
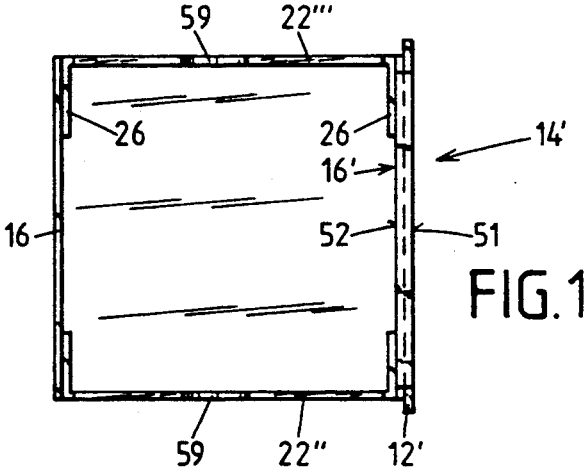
FIG. 10
FIG. 12b
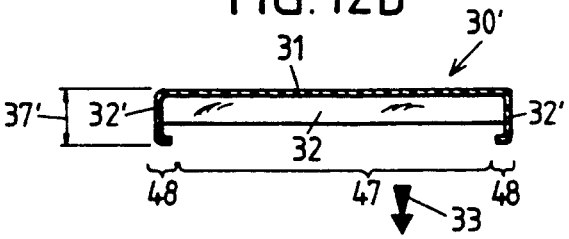
FIG. 11 b
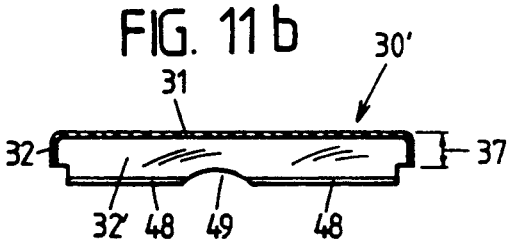
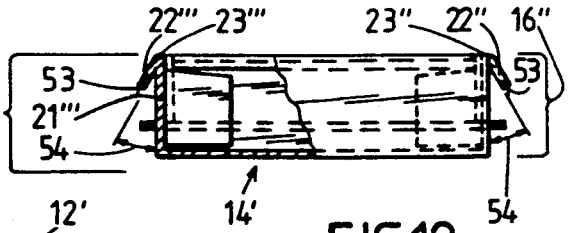
FIG.12a
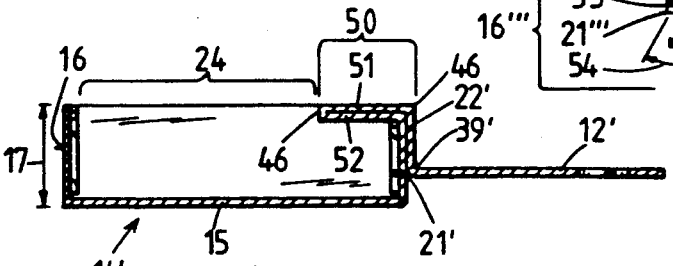
FIG.11a FIG. 15
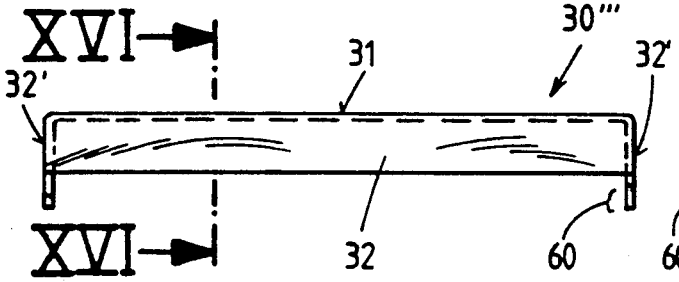
FIG. 16
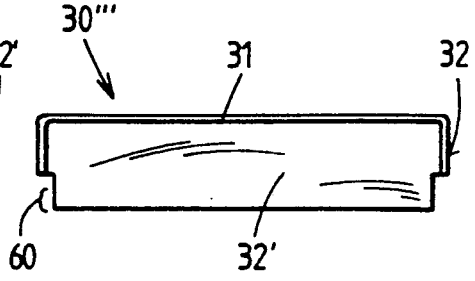
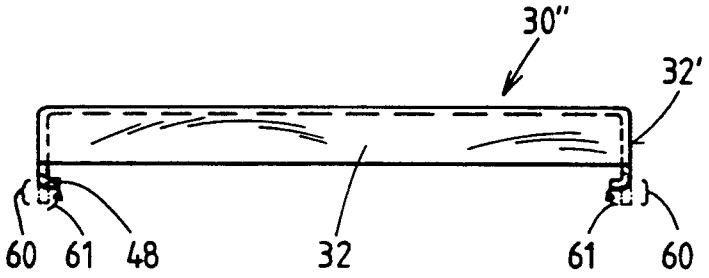
FIG. 17
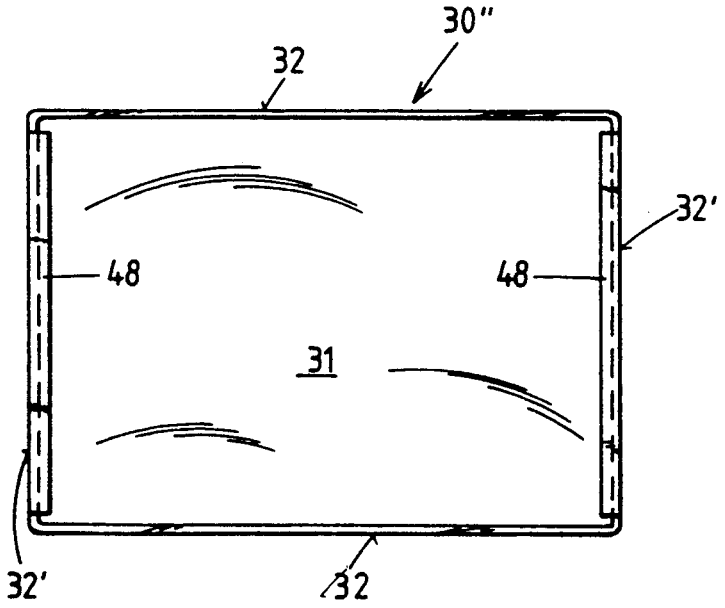
FIG. 18

PACK FOR NOTIONS AND THE LIKE

BACKGROUND OF THE INVENTION

The invention relates to receptacles (hereinafter called packs) which can be utilized for storage and for displaying of notions and/or other relatively small commodities. More particularly, the invention relates to improvements in packs of the type found, for example, in self-service stores for confinement and simultaneous displaying of randomly confined or accurately arrayed groups of commodities in the form of needles, pins, washers, nails, nuts, storage batteries and/or many others within reach of sales personnel and/or prospective purchasers. Still more particularly, the invention relates to packs of the type having a first section made of a degradable material and designed to be suspended on a rod, rail, bar or a like support, and a second section which cooperates with the first section to confine a group of commodities or a single commodity and is normally designed to permit visual inspection of the confined commodity or commodities.

Notions and like commodities are often offered for sale in so-called blister packs wherein the degradable section is made of cardboard or the like and has a flat extension which is provided with an opening to enable a salesperson to slip the extension onto a rail or a like support. A prospective purchaser can remove a blister pack from the rail for the purposes of inspection or for taking to the checkout counter. A drawback of blister packs is that the commodities which are confined between the degradable section and the plastic cover are not readily accessible because the cover is bonded to the carrier in order to prevent accidental spilling or unauthorized removal of the contents. Moreover, a blister pack is rather expensive and, once opened, cannot reassume a state for safe confinement of the entire contents or of the remaining contents of the pack. In addition, the degradable part of a blister pack cannot be readily and/or completely separated from the plastic part. On the other hand, there exists an urgent need for packs wherein the degradable and non-degradable parts can be completely and predictably separated from each other, even before the decomposition of the degradable part begins. This is required by authorities in many countries and in many localities. Thus, the residents of many towns here and abroad are expected to classify refuse into biodegradable and non-degradable components.

Commonly owned U.S. Pat. No. 5,067,611 granted Nov. 26, 1991 to Hagmann et al. discloses a blister pack for storage of needles and like small commodities. The patented pack is constructed and assembled in such a way that it can be opened and resealed as often as desired. Furthermore, a substantial part of the non-degradable section of the patented pack can be readily and completely separated from the degradable section. Withdrawn commodities can be reinserted into the patented pack in the same orientation as in the original pack.

OBJECTS OF THE INVENTION

An object of the invention is to provide a novel and improved pack for storage of pins, needles, clasps, storage batteries, buttons and/or other relatively small commodities in such a way that the commodities are accessible as often as desired, that all of the commodities or the remaining commodities can be reconfigured as often as desired, and that the commodities which are confined can be readily observed at all times even though the pack is not a blister pack.

Another object of the invention is to provide a pack which constitutes an improvement over and a further development of packs of the type disclosed in the aforementioned commonly owned U.S. Pat. No. 5,067,611.

A further object of the invention is to provide a pack which can be used as a superior substitute for blister packs.

An additional object of the invention is to provide a pack wherein the degradable and non-degradable parts can be completely separated from each other as often as desired or necessary.

Still another object of the invention is to provide a simple and inexpensive pack which can be mass produced in available machines and from inexpensive materials.

A further object of the invention is to provide a pack whose stability at least matches that of a blister pack even though the light-transmitting section need not be bonded to the degradable section.

Another object of the invention is to provide a novel and improved degradable section for use in the above outlined pack.

Another object of the invention is to provide a novel and improved plastic section for use in the above outlined pack.

Still another object of the invention is to provide a novel and improved method of converting a blank into a section of the above outlined pack.

A further object of the invention is to provide novel and improved means for indicating the condition (integrity or lack of integrity) of the above outlined pack.

Another object of the invention is to provide the pack with novel and improved means for releasably coupling its sections to one another.

An additional object of the invention is to provide a pack which can be readily and conveniently converted from a suspension type receptacle into a much smaller receptacle capable of being confined in a purse, in a drawer, in the pocket of a garment, on a shelf or at another location where the converted pack is to occupy a minimal amount of space.

Still another object of the invention is to provide an eye-pleasing pack which can be repeatedly opened and closed without any tools or by resorting to rudimentary tools.

SUMMARY OF THE INVENTION

The invention is embodied in a pack which can be used as a means for storing and displaying notions and like relatively small commodities. The improved pack comprises a first one-piece section of degradable material (e.g., stiff paper, cardboard, pasteboard or like biodegradable material) and a second one-piece section of a second material (e.g., a light-transmitting plastic material). The first section comprises a preferably rectangular or square container having an open top, a bottom wall and sidewalls extending from the bottom wall and surrounding the open top, and such first section further comprises a substantially plane carrier which is of one piece with the container. The second section of the improved pack comprises a cover which separably confines at least a portion of the container and comprises a top wall confronting the open top of the container and lateral walls which are outwardly adjacent the side- The carrier is preferably provided with means , at least one hole) for facilitating suspension of the first section on a support (such as a rod, rail or bar in a self-service store). The sidewalls of the container preferably extend beyond the front side of the carrier.

The sidewalls of the container have front edge portions which are disposed at the open top, and the top wall of the cover is or can be closely adjacent to or can actually abut at least some of the front edge portions. One or more sidewalls can comprise a plurality of layers. For example, each sidewall can comprise two overlying panels which are of one piece at the respective front edge portion. Such panels of each multilayer sidewall can include an inner panel which extends from the bottom wall to the respective front edge portion, and an outer panel which extends from the respective front edge portion toward but short of the bottom wall so that a portion of the exterior of the inner panel remains exposed if the container is not entirely confined in the cover. To this end, at least two spaced-apart lateral walls of the cover can be designed and dimensioned in such a way that they extend from the front edge portions of the adjacent sidewalls along the outer sides of such sidewalls toward but short of the bottom wall; this ensures that a portion of the outer side of each sidewall which is only partially overlapped by one of the just outlined lateral walls remains exposed.

The outer panel of each multi-layer sidewall can extend from the respective front edge portion toward the bottom wall of the container, and each such outer panel can comprise an edge which is spaced apart from the front edge portion of the respective sidewall. Each such outer panel is adjacent one lateral wall of the cover (when the cover confines at least a portion of the container), and each such lateral wall can include a projection which overlaps the edge of the adjacent outer panel to thus couple the cover to the container. Each such projection can include or constitute an inwardly bent portion of the respective lateral wall. If the bottom wall of the container and the top wall of the cover have a square or rectangular outline, the sidewalls form two pairs of parallel sidewalls and the lateral walls also form two pairs of parallel lateral walls. The sidewalls of one pair can be provided with inner panels and outer panels which overlie the respective inner panels, and each of the corresponding lateral walls (i.e., each lateral wall of one pair of such lateral walls) has a projection so that the container and the cover are separably coupled to each other along two parallel lateral walls whose projections engage the outer panels of the adjacent sidewalls. As mentioned above, each such projection can constitute an inwardly bent portion of the respective lateral wall, and some or all of the lateral walls can extend from the top wall of the cover toward but short of the bottom wall of the container (it being assumed here that at least a portion of the container is confined in the cover).

If the second material is a plastic (e.g., thermoplastic) material, each projection can constitute a portion of the respective lateral wall, and such portion can be bent inwardly toward the adjacent sidewall as a result of the application of adequate amounts of heat and/or pressure. The arrangement may be such that the lateral walls which are provided with projections extend a first distance from the top wall toward the bottom wall, and the other lateral walls extend a shorter second distance from the top wall toward the bottom wall.

The outer panel of each multi-layer sidewall can exhibit a tendency to pivot away from the respective inner panel along the front edge portion of such sidewall, at least prior to confinement of a portion of the container in the cover. If the first material is at least slightly elastic, the outer panel of each multi-layer sidewall can continue to exhibit a tendency to pivot away from the adjacent inner panel along the respective front edge portion even after prolonged confinement of a portion of the container in the cover.

The first section of the pack preferably constitutes a converted blank of cardboard or an analogous shape-retaining material, and the front edge portion of each multi-layer sidewall can constitute a weakened portion of the blank. Such front edge portion can include an elongated slot and at least one web which is of one piece with the inner and outer panels of the respective sidewall. The arrangement can be such that the front edge portion of each multi-layer sidewall includes two spaced-apart elastic webs which are of one piece with the corresponding inner and outer panels, and an elongated slit between such spaced-apart webs.

The aforementioned weakened portion or portions can constitute the front edge portion or portions of the respective multi-layer sidewall or sidewalls. However, it is equally within the purview of the invention to provide weakened portions close to the front edge portions of multi-layer sidewalls, as long as such weakened portions are apt to be destroyed by the projections of the adjacent lateral walls during extraction of the container from the cover. The aforementioned slit or slits in or at the front edge portions of multi-layer sidewalls can be provided between partially or fully severed zones of such front edge portions, and the afore-mentioned webs are preferably designed to break readily in response to the application of requisite stress by the projections of the adjacent lateral walls while the lateral walls are being pulled off the adjacent sidewalls and/or while the sidewalls are being extracted from the cover by moving along the projections of the adjacent lateral walls. One presently preferred mode of weakening some or all front edge portions of multi-layer or multi-panel sidewalls is to provide such edge portions with pairs of relatively narrow and readily breakable webs and with an elongated through slot or slit between such webs.

That edge or those edges of one or more lateral walls which are remote from the top wall of the cover can be provided with one or more recesses or notches for reception of fingers to facilitate separation of the cover from the container.

The sidewalls of the container can be said to jointly form an enclosure for commodities at the bottom wall of the container, and such enclosure consists of pairs of neighboring sidewalls. At least one sidewall of each such pair can be provided with a flap which is overlapped by the other sidewall of the respective pair. Such flaps are of one piece with the respective sidewalls. If each sidewall is a multi-layer sidewall having an inner panel, an outer panel and a front edge portion constituting a hinge between the two panels, the flaps are preferably of one piece with the inner panels of the respective sidewalls. Each such flap is then overlapped by the inner panel of the other sidewall of the respective pair of sidewalls. The inner panel of the one sidewall of each pair of sidewalls is preferably provided with two flaps. Each flap can be rigid with the other sidewall of the respective pair of sidewalls; for example, the flaps can be bonded (e.g., by resorting to a suitable adhesive) to the overlapping sidewalls.

The container can be further provided with at least one information-bearing tongue which is of one piece with one of the sidewalls and is preferably adjacent the top wall of the cover when the latter confines a portion of the container. The tongue can comprise two overlapping portions one of which is of one piece with the one sidewall and the other of which is of one piece with the one portion. If the one sidewall includes an inner panel and an outer panel, the inner panel is of one piece with the bottom wall and the outer panel is outwardly adjacent the inner panel and is of one piece with the carrier. The one portion of the at least one tongue is of one piece with the inner panel and the outer panel is disposed between the carrier and the other portion of the tongue. Such outer panel is of one piece with the other portion of the at least one tongue. The tongue can be substantially parallel to the bottom wall of the container.

The width of the container can at least approximately the width of the carrier. In accordance with a presently preferred embodiment, the blank which is converted into the first section including the container and the carrier can be configurated and dimensioned in such a way that the width of the carrier exceeds the width of the container by 2A+2B wherein A is the thickness of a sidewall and B is the thickness of a lateral wall.

The first section of the improved pack can comprise a weakened portion (e.g., a portion having at least one row of perforations) between the container and the carrier to permit predictable and convenient (effortless) separation of the carrier from the container. The arrangement can be such that the sidewall which is of one piece with the carrier includes an inner panel and an outer panel which overlies the inner panel. The outer panel has a first elongated marginal portion which is of one piece with the inner panel and a second elongated marginal portion which constitues the weakened portion and is of one piece with the carrier.

The carrier can be located in a plane between the top wall of the cover and the bottom wall of the container. The center of gravity of an intact pack (wherein the commodities are received in the container and are kept therein by the cover) can be located in such plane. This permits predictable suspension of the carrier on a bar, rod or rail in a self-service store, in a shop or in another establishment where such packs can be put on display for the purpose of sale or for the purpose of storage of confined commodities for convenient observation and convenient access by the hand of a housewife, a tinker, a mechanic or another person.

The first section is a converted blank having a preferably colored (e.g., multicolored) front side and a rear side. The front surface of the bottom wall (namely the surface which confronts the top wall of the cover), the internal surfaces of the sidewalls of the container (namely those surfaces which confront each other), and portions of or the entire external surfaces of the sidewalls preferably form part of the front side of the converted blank, the same as the front surface of the carrier. The front surface of the aforementioned tongue (namely that surface which confronts the top wall of the cover) also forms part of the front side of the converted blank.

The rear surface of the bottom wall of the container and the rear surface of the carrier form part of the rear side of the converted blank. First portions of the external surfaces of the sidewalls can form part of the rear side and the remaining second portions of such external surfaces can form part of the front side of the converted blank. The rear side of the converted blank can be unicolored or multicolored or retains the natural hue of the material of the blank.

The novel features which are considered as characteristic of the invention are set forth in particular in the appended claims. The improved pack itself, however, both as to its construction and the mode of assembling and opening or closing the same, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a front elevational view of a pack which embodies one form of the invention;

FIG. 2 is a side elevational view of the pack which is shown in FIG. 1;

FIG. 3 is a sectional view substantially as seen in the direction of arrows from the line III—III in FIG. 1;

FIG. 4 is an enlarged fragmentary exploded view of the left-hand portion of certain parts of the structure which is shown in FIG. 3;

FIG. 5 is an enlarged fragmentary sectional view substantially as seen in the direction of arrows from the line V—V in FIG. 1;

FIG. 8 is a side elevational view of a partly converted blank of the type shown in FIG. 7;

FIG. 9 is a front elevational view of the partly converted blank of FIG. 8;

FIG. 10 is a plan view of the partly converted blank of FIG. 8;

FIG. 11*a* is a central longitudinal sectional view of a first section which is obtained upon completion of conversion of the blank of FIG. 7.

FIG. 11*b* is a similar sectional view of the associated cover;

FIG. 12*a* is an end elevational view, partly broken away, of the first section, substantially as seen in the direction of arrows from the line XIIa—XIIa in FIG. 13*a;*

FIG. 12*b* is a transverse sectional view of the cover which is shown in FIG. 11*b;*

FIG. 15 is an enlarged elevational view of a cover which is analogous to the cover of FIGS. 11*b*, 12*b* and 14 and is shown in a condition prior to thermally and/or pressure induced deformation of the free edges of two of its lateral walls;

FIG. 16 is a sectional view substantially as seen in the direction of arrows from the line XVI—XVI in FIG. 15;

FIG. 17 is an elevational view similar to that of FIG. 15 but showing the cover upon completion of deformation of two of its lateral walls; and FIG. 18 is a bottom plan view of the cover which is shown in FIG. 17.

DESCRIPTION OF PREFERRED EMBODIMENTS

Figure 6:
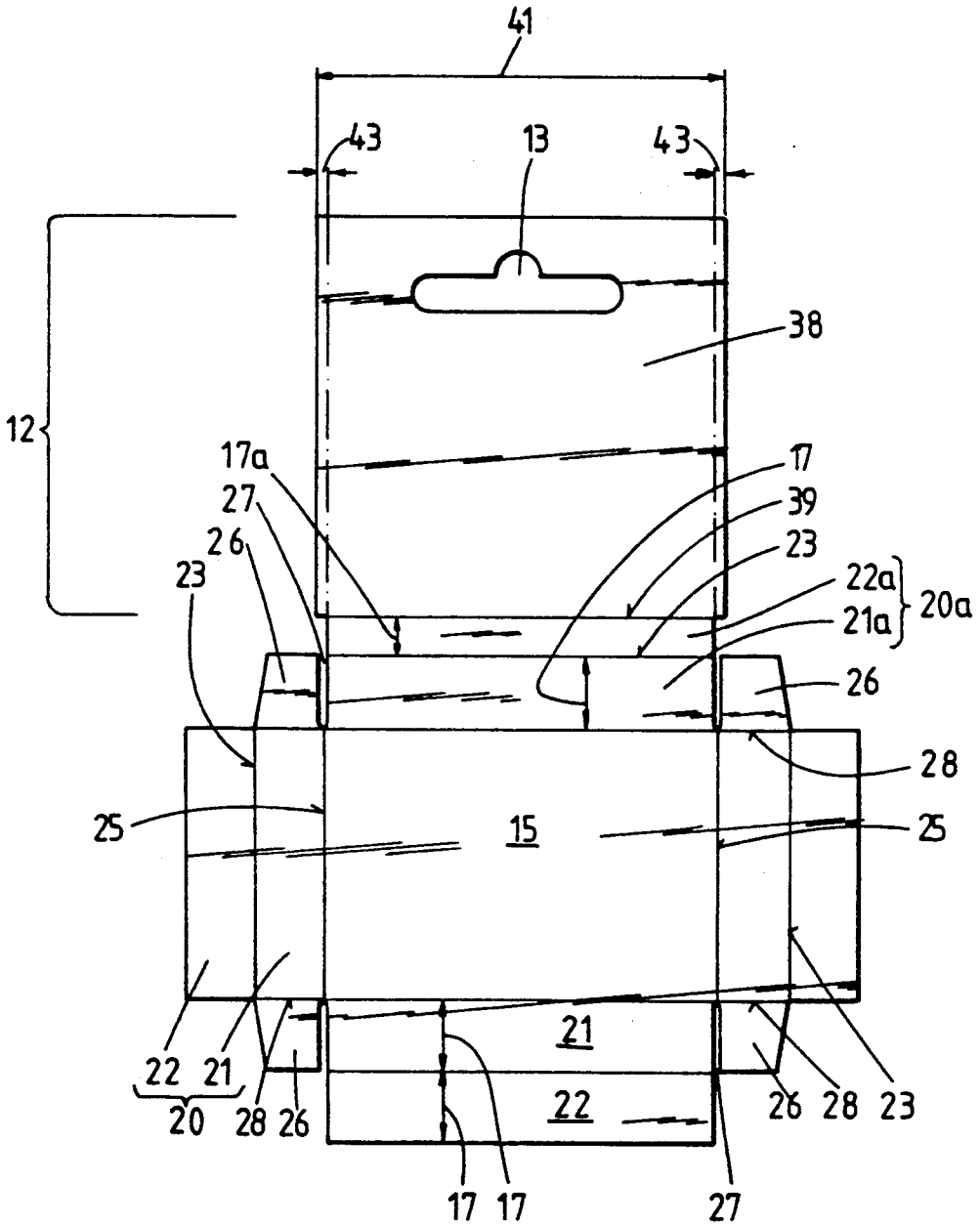
FIG. 6 is a plan view of a blank which can be converted into the first section of the pack of FIGS. 1 and 2.

Referring first to FIGS. 1 to 5, there is shown a pack 10 which can be utilized for storage and display of relatively small commodities. FIG. 1 shows a group of randomly oriented safety pins 34 which are confined between a rectangular or square container 14 and a rectangular or square cover 30. The pack 10 is made of two sections, namely a first section including the container 14 and a plane carrier 12, and a second section constituted by the cover 30. The first section constitutes a converted blank (the blank is shown in FIG. 6) of cardboard, relatively stiff paper or other degradable material. The cover 30 is made of a suitable light-transmitting (transparent or translucent) plastic material which permits observation of the contents of the container 14 from the front side of the pack 10 (as shown in FIG. 1). The height 11 of the container 14 exceeds the height of the carrier 12, and the latter is provided with a suitably profiled opening 13 which enables a clerk or another person in self-service store, in a hardware store or in another establishment to slip the carrier 12 onto an elongated rail (not shown) or onto an analogous support where the pack 10 is on display to prospective purchasers.

The container 14 has a flat bottom wall 15, four sidewalls 16, 16*a* which are of one piece with the respective sides of and extend at right angles to the bottom wall 15, and an open top 24 at the front edge portions 23 of the sidewalls 16, 16*a*. The cover 30 comprises a flat top wall 31 which can abut the front edge portions 23 of some or all of the sidewalls 16, 16*a* when the container 14 is at least partially confined in the cover (see FIGS. 2 and 3), and four lateral walls 32 which are of one piece with the respective sides of and extend at right angles to the plane of the top wall 31. The container 14 can be said to constitute the male portion, and the cover 30 can be said to constitute the female portion of a composite receptacle for the commodities 34. In order to assemble the receptacle, the cover 30 is slipped onto the adjacent portions of the sidewalls 16 and 16*a* in the direction of arrow 33 (FIG. 4) or the sidewalls 16 and 16*a* are inserted into the cover 30 by moving them upwardly, as viewed in FIG. 4. The dimensions of the container 14 and of the cover 30 can be selected in such a way that the internal surfaces of the lateral walls 32 are in more or less pronounced frictional engagement with the external surfaces of the respective sidewalls 16 and 16*a* when the assembly of the receptacle is completed.

The height 17 of the three identical or similar sidewalls 16 and of a fourth sidewall 16*a* is or can be the same (refer to the blank of FIG. 6). Each of the three sidewalls 16 includes an inner panel 21 and an outer panel 22 which overlies the outer side of and is of one piece with the respective inner panel 21 along the corresponding front edge portion 23. This can be best seen in FIGS. 3, 4 and 6. The height (17) of each inner panel 21 matches the height of the corresponding outer panel 22. The height of the inner panel 21*a* of the fourth sidewall 16*a* is the same as that of any inner panel 21; however, the height (17*a*) of the outer panel 22*a* of the sidewall 16*a* is less (FIGS. 5 and 6). Since the carrier 12 is of one piece with the outer panel 22*a*, the plane of this carrier is located between the planes of the walls 15 and 31, preferably at a level such that the center of gravity of the fully assembled and filled pack 10 is located in the plane of the carrier 12. This facilitates predictable suspension of the pack 10 on a rail or another suitable elongated support.

The height 18 (FIG. 2) of the cover 30 is less than the height 17 of the sidewalls 16 and 16*a* so that a substantial portion (shown at 19 in FIG. 2) of each sidewall 16 remains exposed when the container 14 is confined in the cover 30 to the maximum extent (FIG. 3), i.e., so that the front edge portions 23 of the sidewalls 16, 16*a* actually abut the inner side of the top wall 31.

The blank of FIG. 6 (i.e., the initial form of the first section including the container 14 and the carrier 12) can be mass produced in a stamping or any other suitable machine from cardboard or other degradable material. The blank is provided with slits, fold lines, rows of perforations and/or other features which permit predictable and convenient folding of neighboring portions of the blank relative to each other in order to convert the blank into the container 14 with bottom wall 15 and four sidewalls 16, 16*a* as well as into the carrier 12 which is of one piece with the outer panel 22*a* of the sidewall 16*a*.

FIGS. 1, 2 and 3 show patches 35 of adhesive-coated material which are used to reliably but separably connect two lateral walls 32 to the adjacent sidewalls 16. The patches 35 adhere to the exposed portions (19) of the external surfaces of the inner panels 21 forming part of the respective sidewalls 16. Once the patches 35 are detached from the cover 30 and/or from the adjacent sidewalls 16, they are no longer capable of securing the container 14 and the cover 30 to each other in the same way as the first time so that this indicates to a careful purchaser or to a clerk that the pack 10 was already opened. Other types of means for reliably but separably confining a portion of the container 14 in the cover 30 can be used with equal or similar advantage. For example, the lateral walls 32 of the cover 30 can be provided with arms which overlie the exposed rear surface of the bottom wall 15 when the pack 10 is intact but such arms must be deformed or broken away in order to gain access to the contents of the container 14. This indicates to an attentive purchaser or clerk that the pack 10 has been tampered with. Another mode of readily indicating whether or not the pack is intact will be described and shown with reference to the embodiments which are illustrated in FIGS. 7 to 18.

The configuration of a section (including a container 14 and a carrier 12) which can be obtained in response to conversion of the blank of FIG. 6 departs from that of the section of FIGS. 1 and 2 in that the container 14 and the cover 30 of FIGS. 1 and 2 have a substantially square outline. Each of the four sidewalls of the container 14 is obtained by folding a relatively large panel 20 or 20*a* along the respective fold line (front edge portion 23) to form two panels 21, 22 or 21*a*, 22*a* together constituting the respective sidewall 16 or 16*a*. The inner panels 21, 21*a* are to be pivoted relative to the panel which is to constitute the bottom wall 15 along fold lines 25. When the formation of the sidewalls 16, 16*a* is completed, each inner panel 21, 21*a* extends from the respective fold line 25 to the respective front edge portion 23, and each of the outer panels 22, 22a extends from the respective front edge portion 23 toward the respective fold line 25. As can be seen in FIG. 6, the width 17 of the panel 22 matches or approximates the width (17) of the adjacent outer panel 22 of a sidewall 16, but the width (17) of the panel 21a exceeds the width (17') of the respective outer panel 22a. The front edge portions 23 of sidewalls 16, 16a of the finished container 14 surround the open top 24 of such container.

The blank of FIG. 6 has a preferably colored (e.g., multicolored) front side 38 and a rear side 36 whose color or hue can match that of cardboard or other degradable material of which the blank is made. When the container 14 is finished, the front or inner surface of the bottom wall 15 forms part of the front side 38 of the converted blank of FIG. 6, the same as the internal surfaces of the panels 21, 21a, the external surfaces of the panels 22, 22a and the front surface of the carrier 12. The rear side 36 can be unicolored or even multicolored; such rear side 36 can bear information pertaining to the dimensions, mode of utilizing, cost and/or other parameters of the commodities which are confined between the container 14 and the cover 30. The rear surface of the carrier 12 forms part of the rear side 36 of the converted blank of FIG. 6, the same as the exposed portions (at 19) of the external surfaces of the inner panels 21, 21a.

The panels 22, 22a may but need not be rigid with the respective panels 21, 21a. For example, such panels of each sidewall can be adhesively secured, stapled or otherwise more or less permanently affixed to each other.

The reference character 39 denotes in FIGS. 2, 5 and 6 a fold line which is provided between the outer panel 22a of the sidewall 16a and the carrier 12. This fold line is spaced apart from the adjacent fold line 25 as well as from the respective front edge portion 23 because the plane 40 (FIG. 5) of the carrier 12 is located between the planes of the bottom wall 15 and top wall 31. The distance of the plane 40 from the plane of the front edge portions 23 equals or approximates the width 17' of the panel 22a, and the distance of the plane 40 from the plane of the bottom wall 15 (shown in FIG. 5, as at 29) equals 17 minus 17'. The fold line 39 can include a row of perforations to permit convenient and predictable separation of the carrier 12 from the container 14. This will be described in greater detail with reference to the embodiments of FIGS. 7 to 18.

FIGS. 3 to 6 show that the longitudinal ends of two of the three inner panels 21 are of one piece with pairs of flaps 26. Such flaps can be pivoted relative to the respective inner panels 21 along fold lines 28 which are in line with the fold lines 25 connecting the bottom wall 15 with the inner panel 21 of the third sidewall 16 and with the inner panel 21a of the sidewall 16a. The flaps 26 are separated from the adjacent inner panels 21, 21a by relatively narrow clearances or gaps 27 (FIG. 6) which disappear when the blank is converted into a section including a container 14 and a carrier 12.

When the conversion of the blank of FIG. 6 into the first section of the pack 10 is completed, the flaps 26 are adjacent to and are preferably rigid with the adjacent portions of internal surfaces of those panels (21, 21a) which are devoid of flaps. Each such flap can be stapled and/or bonded (e.g., adhesively secured) to the adjacent inner panel. Such attachment of flaps 26 to the internal surfaces of the adjacent inner panels contributes significantly to the stability of the container 14 and hence to the stability of the receptacle including such container and the respective cover 30. Those surfaces of the flaps 26 which can be seen through the open top 24 of the container 14 form part of the front side 38 of the blank of FIG. 6, i.e., the flaps do not detract from the appearance of the first section if the front side of the blank is multicolored or otherwise decorated to enhance the appearance and the sales appeal of the pack 10. Thus, the entire internal surface of the container 14 (including the internal surface of the bottom wall 15, the internal surfaces of the inner panels 21, 21a and the internal surfaces of the flaps 26) forms part of the preferably multicolored and/or otherwise decorated front side 38 of the converted blank.

FIGS. 1 and 6 show that the width 41 of the carrier 12 can equal or approximate the width 42 of the container 14. The width 42 depends on the dimensions of the cover 30, i.e., those portions of the sidewalls 16, 16a which are adjacent the respective front edge portions 23 should be capable of being preferably snugly confined in the cover 30 when the assembly of the pack 10 is completed. As can be seen in FIG. 6, the blank can be dimensioned in such a way that the width 41 of the carrier 12 exceeds the width of the bottom wall 15 by 2A plus 2B (equals two difference 43 shown in FIG. 6) where in A is the thickness (see 44 in FIG. 4) of a sidewall 16 or 16a and B is the thickness (see 45 in FIG. 4) of a lateral wall 32. This ensures that the external surfaces of two of the lateral walls 32 in a fully assembled pack 10 are coplanar with the respective edges 12a of the carrier 12 (see FIG. 1).

The rear side 36 of the blank of FIG. 6 (and more particularly those portions of the rear side 36 which constitute the rear or outer surface of the bottom wall 15 and the rear surface of the carrier 12) can be unicolored (e.g., white) and can bear information including the aforementioned dimensions of confined commodities, instructions to use such commodities, the expiration date of usability of the commodities, the suggested retail price and/or others.

FIG. 6 shows that a flap 26 is disposed between each pair of neighboring panels 21, 21a. Each flap 26 is of one piece with one panel (21) of such pair and can be bonded or otherwise affixed to the other panel (21 or 21a) of the respective pair.

The width 37 (FIG. 4) of lateral walls 32 is a little less than the height 18 of the cover 30.

Figure 7:
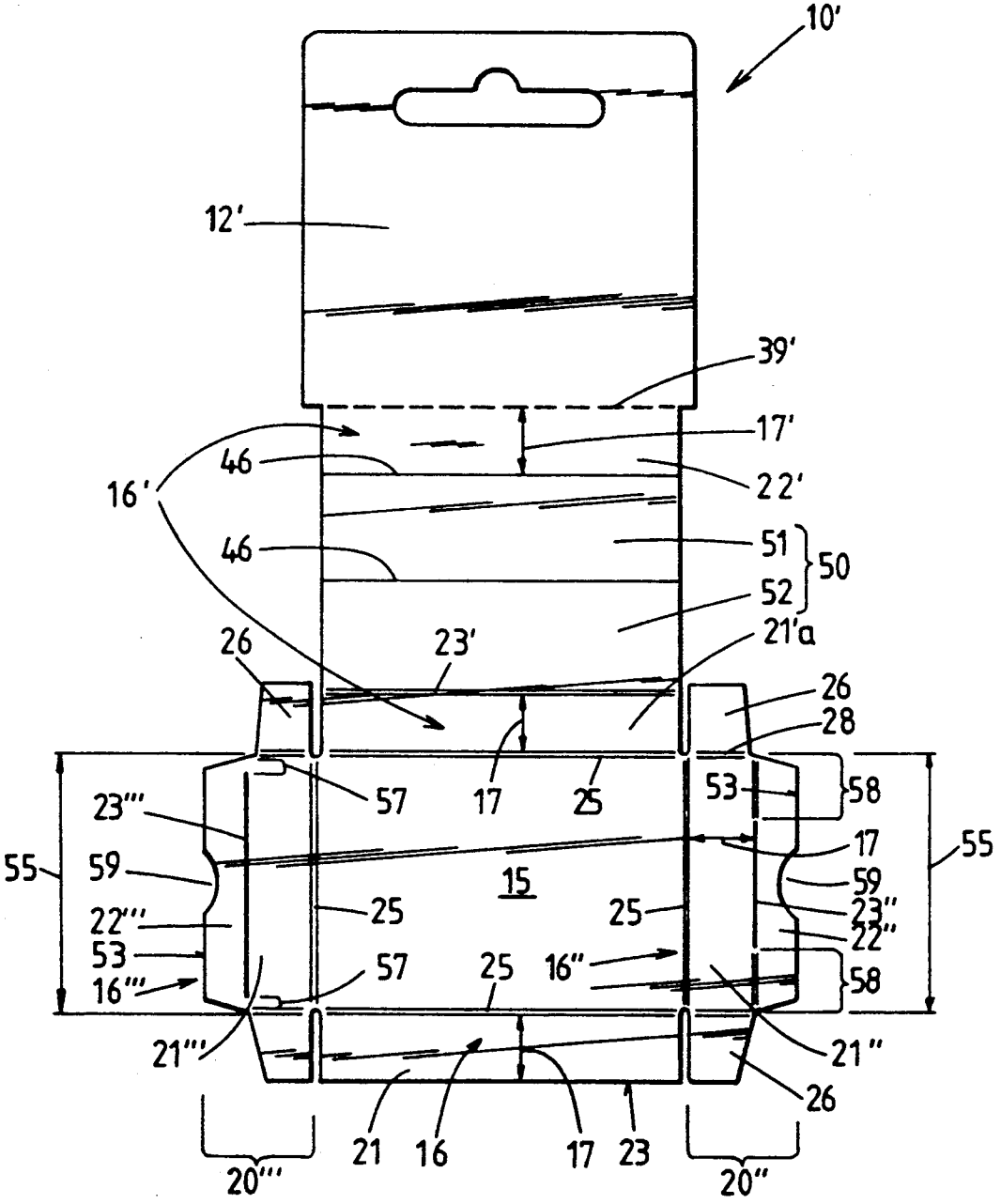
FIG. 7 is a plan view of a second blank which can be converted into a first section of the type shown in FIG. 11*a;*

FIG. 7 shows a second blank which can be converted into the first section of a pack 10' of the type shown in FIGS. 11a and 11b or 12a and 12b or 14. Many parts of the pack 10' are identical with or clearly analogous to the corresponding parts of the pack 10; such identical or analogous parts of the pack 10' are denoted by similar reference characters some of which are followed by primes. FIG. 7 shows that one (16) of the four sidewalls 16, 16', 16'', 16''' of the first section to be obtained as a result of conversion of the second blank each includes a single panel (21) having a width 17 from the respective fold line 25 to the respective front edge portion 23. The two shorter sidewalls 16'', 16''' of the container 14' each have an inner panel 21'', 21''' and an outer panel 22'', 22'''. Prior to folding along the respective front edge portions 23'' and 23''', the panels 21'', 22'' together constitute a larger panel 20'', and the panels 21''', 22''' together constitute a larger panel 20''' of the respective blank.

In the blank of FIG. 7, that part which is to form the carrier 12' is remote from the bottom wall 15 of the future container 14' because the pack 10' further comprises a tongue 50 including two flat elongated portions 51, 52 which are of one piece along a straight fold line 46. Another fold line 46 connects the portion 51 of the tongue 50 with the outer panel 22' of that sidewall 16' which is of one piece with the carrier 12', and the inner panel 21' of such sidewall is of one piece with the bottom wall 15 (at the respective fold line 25) and with the portion 52 of the tongue 50 along the respective front edge portion 23'. When the conversion of the blank of FIG. 7 into the first section of the pack 10' is completed (see FIGS. 11*a*, 12*a* and 13*a*), the tongue 50 is at least substantially parallel to the top wall 31 of the properly applied cover 30' and is spaced apart from and parallel or nearly parallel with the bottom wall 15 of the container 14'. The fold line 39' between the carrier 12' and the outer panel 22' of the adjacent sidewall 16' of the container 14' can be provided with a row of perforations, with a row of slits, or it can be weakened in any other suitable way to permit predictable and effortless separation of the carrier 12' from the container 14'. Such separating step will be carried out by the purchaser of the pack 10' when the purchaser desires to store the receptacle including the container 14' and the cover 30' in a small area, e.g., in a crowded handbag, in the pocket of a suit, in a crowded shopping bag, in a briefcase or the like. That surface of the tongue 50 which confronts the top wall 31 of the properly applied cover 30' can bear inscriptions and/or other indicia. As can be readily seen by referring to the blank of FIG. 7, that surface of the portion 51 of the tongue 50 which can be seen through the top wall 31 of the cover 30' forms part of the preferably colored (e.g., multicolored) front side of the blank so that it does not detract from the appearance of the finished pack 10'.

The carrier 12' can also be separated from the container 14' (along the weakened fold line 39') by a housewife, by a tinker or by an artisan who desires to reduce the space requirements of the pack 10' as soon as the pack is paid for. The application of information (e.g., certain more important information) on the front surface of the portion 51 of the tongue 50 ensures that such information remains intact and is readily observable prior to and after separation of the carrier 12' from the container 14'. Of course, the tongue 50 and/or any other part of the improved pack 10 or 10' will normally also bear information pertaining to the trademark(s) of the maker, the name and address of the maker, the telephone number of the maker and/or other data which are expected to be found on packs for notions and other relatively small commodities of the type to be purchased in self-service stores, hardware stores, certain markets, stationery stores and/or similar establishments.

Figure 14:
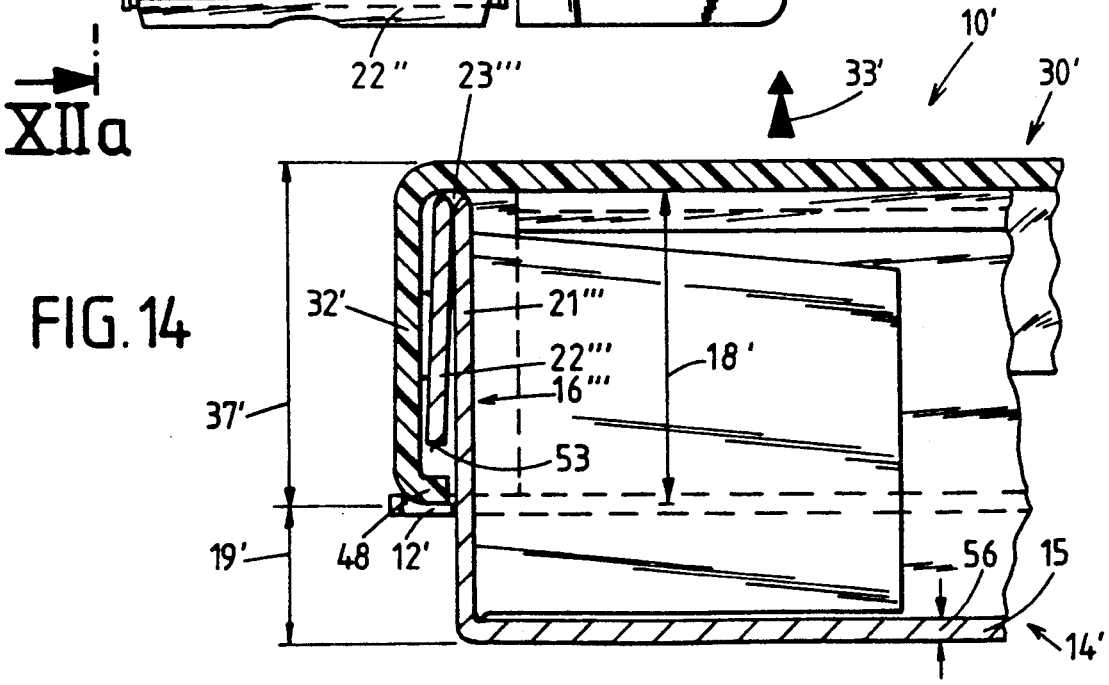
FIG. 14 is a greatly enlarged view of the structure which is shown in the left-hand portion of FIG. 12*a*, and further showing the left-hand portion of the cover of FIG. 12*b* subsequent to its application over the open top of the container of the first section.

In FIG. 7, the character 17' denotes the width of the outer panel 22' of the sidewall 16', and the character 18' of FIG. 14 denotes the width of the lateral walls 32'. The character 19' denotes in FIG. 14 the width of that portion of each of the sidewalls 16'', 15''' which remains exposed when the application of the cover 30' to the container 14' is completed.

Figure 13B:
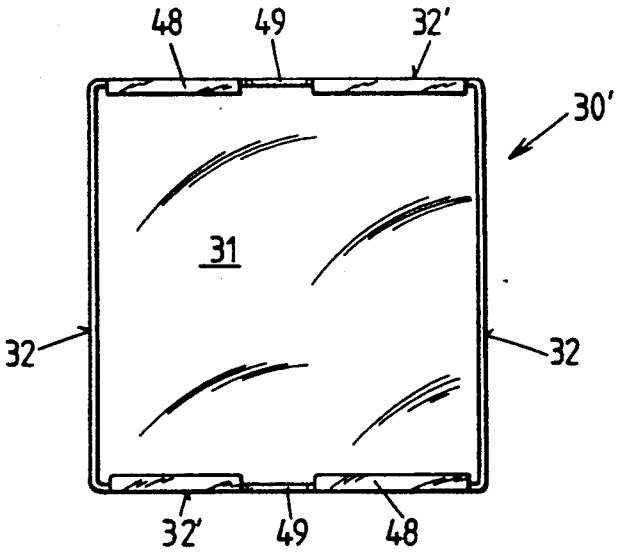
FIG. 13*b* is a bottom plan view of the cover as seen from the underside of FIG. 11*b* or 12*b;*
Figure 13A:
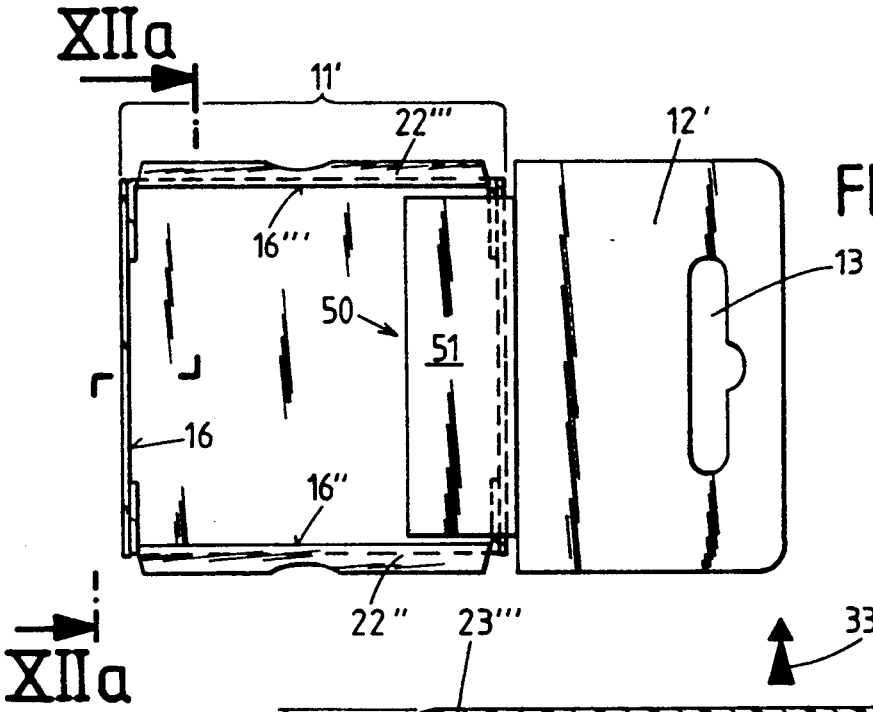
FIG. 13*a* is a front elevational view of the first section which is shown in FIGS. 11*a* and 12*a;*

FIGS. 11*b*, 12*b* and 13*b* show that the cover 30' of the pack 10' comprises two first parallel lateral walls 32 having a first width 37, and two second parallel lateral walls 32' having a greater second width 37'. Those edges of the wider lateral walls 32' which are remote from the top wall 31 are provided with pairs of inwardly extending projections 48, and the projections 48 of each such pair of projections are separated from each other by a rounded recess or notch 49 which permits insertion of a portion of a finger to facilitate separation of the cover 30' from the container 14' of an assembled pack 10'. The projections 48 extend inwardly, i.e., toward the external surfaces of the adjacent sidewalls 16'', 16''' of the container 14' (see particularly FIG. 14) so that they can overlap the adjacent edges 53 of the adjacent outer flaps 22'', 22''' to thus reduce the likelihood of accidental separation of the cover 30' from the container 14' in fully assembled condition of the pack 10'. The projections 48 reduce the width of the inlet 47 (FIG. 12*b*) of the cover 30', i.e., of that portion of the space between the lateral walls 32' which is available for introduction of portions of sidewalls 16—16''' of the container 14'.

The width of the outer panels 22'', 22''' of the sidewalls 16'' and 16''' is considerably less than the width 17 of the adjacent inner panels 21'', 21''' (see FIGS. 7, 12*a* and 14). Therefore, the edges 53 of the panels 22'', 22''' are spaced apart from the bottom wall 15 of the container 14' when the conversion of the blank of FIG. 7 into the first section of the pack 10' is completed. Moreover, the outer panels 22'', 22''' exhibit a tendency to pivot away from the respective inner panels 21'', 21''' along the respective front edge portions 23'', 23''' which act not unlike hinges and enable the outer panels 22'', 22''' to pivot against the internal surfaces of the adjacent lateral walls 32' so that the edges 53 are overlapped by the corresponding pairs of projections 48 to thus separably lock the cover 30' to the container 14'. Suitable acute angles 54 between the inner panels 21'', 21''' and the adjacent outer panels 22'', 22''' are shown in FIG. 12*a*. Such angles suffice to ensure that the projections 48 of the two lateral walls 32' invariably overlie the edges 53 of the adjacent outer panels 22'', 22''' when the container 14' is partially received in the cover 30' (see FIG. 14). The front edge portions 23'' and 23''' are preferably designed in such a way that they compel the outer panels 22'', 22''' to continue to exhibit a tendency to pivot away from the external surfaces of the adjacent inner panels 21'', 21''', even after prolonged periods of attachment of the cover 30' to the container 14'. This ensures that the receptacle including the container 14' and the cover 30' can be closed again and again. Furthermore, this ensures that an observant purchaser or clerk can readily ascertain whether or not a pack 10' has been tampered with.

If a purchaser or a clerk decides to pull the cover 30' away from the container 14' (note the arrow 33' in FIG. 14), the projections 48 of the lateral walls 32' strike against the edges 53 of the respective outer panels 22'', 22'''. If the pull in the direction of arrow 33' is not pronounced, the panels 22'', 22''' and their edges 53 interrupt further lifting of the cover 30' off the container 14'. If the person manipulating the pack 10' continues to exert a force acting in the direction of the arrow 33' and sufficing to advance the projections 48 toward the open top of the container 14', the connection between the panel 22'' and/or 22''' on the one hand and the panel 21'' and/or 21''' is deformed or destroyed which can result in complete separation of the outer panel 22'' and/or 22''' from the respective inner panel 21'' and/or 21'''.

Each of the front edge portions 23'', 23''' is a weakened portion of the respective sidewall 16'', 16'''. As shown in FIGS. 7 and 14, this can be achieved in the following way: Each of these front edge portions includes two preferably elastic webs 57, 58 which are of one piece with the panels 21'', 22'' and 21''', 22''', respectively. The webs 58 are spaced apart from each other (FIG. 7) and flank the respective ends of an elongated slit which may but need not extend all the way through the material of the blank. Analogously, the front edge portion 23''' comprises two spaced apart elastic webs 57 which are adjacent the respective ends of a slit extending through the material of the blank, either entirely or in part. The slits of the edge portions 23'', 23''' occupy the major parts of the overall lengths (shown at 55 in FIG. 7) of the corresponding pairs of panels 21'', 22'' and 21''', 22'''. FIG. 14 shows that the slit of the front edge portion 23''' extends all the way through the material of the first section between the panels 21''', 22''' so that such panels are held together only by the very narrow webs 57 (which can be narrower than the webs 58 of the front edge portion 23'' of vice versa). The thickness of the material of the first section of the pack 10' is shown in FIG. 14, as at 56.

When a person desiring to gain access to the contents of the receptacle including the container 14' and the cover 30' decides to exert a pronounced pull in the direction of arrow 33' of FIG. 14, the webs 57 are readily destroyed and the outer panel 22''' of the sidewall 16''' becomes separated from the inner panel 21'''. Such separation can but need not take place simultaneously with destruction of the webs 58 forming part of the front edge portion 23''. Separation of the outer panel 22'' or 22''' from the respective inner panel 21'' or 21''' is a clear indication that the pack 10' has been tampered with or that someone in authority has decided to detach the cover 30' from the container 14'. The projections 48 of the lateral walls 32' can be said to replace the adhesive patches 35 which are shown in FIGS. 1 to 3 in that they serve as a means for indicating the integrity or lack of integrity of the pack 10'. Thus, it is not necessary to resort to separately produced and applied adhesive patches because the integrity or lack of integrity is indicated by integral parts (22'', 22''' and 48) of the two components of the pack 10'. Such construction is preferred at this time because the constituents of the pack 10' can be even more accurately separated according to the composition of their materials, namely into a first section (made of the blank of FIG. 7) consisting in its entirety of a first (preferably degradable) material and a second section (cover 30') made in its entirety of a second material (such as a transparent or translucent plastic substance).

The tendency of the webs 57 and 58 to pivot the respective outer panels 22'', 22''' away from the adjacent inner panels 21'', 21''' can be readily established by avoiding the provision of fold lines or other configurations which would weaken the webs and would reduce their ability to establish the angle 54 which are shown in FIG. 12*a*. Thus, the innate resiliency of the material of the webs 57 and 58 is preferably left intact to ensure that such resiliency can be relied upon, when necessary, for extended periods of time.

The front edge portion 23'' of the sidewall 16'' of the container 14' can but need not be analogous to the front edge portion 23''' of the sidewall 16''. As shown in FIG. 7, the front edge portion 23'' can comprise a relatively short centrally located slit (shown by a heavy line), which may but need not extend all the way through the material of the blank, and with two relatively long webs 58 which are adjacent the respective ends of the slit and together form a resilient hinge between the panels 21'' and 22''. The panels 21'', 22'' can be folded relative to each other and relative to the bottom wall 15 (along the front edge portion 23'' and along the respective fold line 25) to convert the corresponding relatively wide panel 20'' of the blank of FIG. 7 into the sidewall 16''. The purpose of the slit (rather than a through slot) between the central portions of the panels 21'', 22'' is to ensure predictable folding of such panels relative to each other but to prevent undue weakening of the material of the blank between the panels. The webs 58 need not be grooved or otherwise weakened because predictable folding of the panels 21'', 22'' relative to each other in the region of such webs is ensured by the provision of the slit in the central zone of the front edge portion 23''. Absence of any fold lines or other weakening means in the webs 58 ensures that the resiliency of such webs suffices to pivot the outer panel 22'' away from the inner panel 21'' before the container 14' is received in the cover 30' and as soon as the container is extracted from the cover.

The arrangement may be such that the connection between the panels 21'', 22'' remains intact whereas the connection between the panels 22''', 23''' is destroyed as the cover 30'' is pulled off the container 14''. This entails as certain deformation of the outer panel 22'' but this panel continues to adhere to the panel 21'' along the front edge portion 23''. In order to facilitate separation of the cover 30' from the container 14', the outer panels 22'', 22''' can be provided with recesses or notches 59 to facilitate entrainment of the outer panels 22'', 22''' with the respective lateral walls 32' of the cover 30' when the latter is to be detached from the container 14'. Such detachment entails a pivoting of the cover 30' relative to the front edge portion 23'' as soon as the webs 57 are destroyed, i.e., as soon as the outer panel 22''' is separated from the inner panel 21''' of the sidewall 16'''. The outer panel 22'' is then flattened against the inner panel 21'' so that the projections 48 of the respective lateral wall 32' can slide over the edge 53 of the inwardly pivoted outer panel 22''. Thus, the original shape of the sidewall 16'' remains intact when the separation of the cover 30' from the container 14' in the direction of arrow 33' of FIG. 14 is completed. The person in charge of manipulating the pack 10' has gained access to the contents of the receptacle including the container 14', and the receptacle can be closed again by the simple expedient of slipping the cover 30' back onto the container 14'. This involves a renewed movement of the cover 30' in the direction of arrow 33 (FIGS. 12*a* and 12*b*). The projections 48 of the right-hand lateral wall 32' of FIG. 12*b* slide over the outer panel 22'' and overlie the edge 53 of this outer panel when the flat top wall 31 of the cover 30' reaches the front edge faces 23'', 23'''. The projections 48 of the right-hand lateral wall 32' of FIG. 12*b* and the adjacent outer panel 22'' cooperate not unlike the male and female components of a snap fastener which establishes a purely mechanical connection between the cover 30' and the container 14'. The user can detach and reattach the cover 30' as often as necessary.

When the receptacle including the container 14' is empty, the first section (including the container and the carrier 12') can be stored for disposal independently of the second section including the plastic cover 30'. The first section can be disposed of with newspapers and other decomposable materials, and the second section can be recycled or otherwise disposed of in an ecologically acceptable manner.

The fasteners including the projections 48 and the corresponding outer panels 22'', 22''' are sufficiently strong to ensure that the contents of the pack 10 or 10' remain confined between sidewalls 16 and 16a or 16—16''' and the bottom wall 15 even if the pack 10 or 10' is turned upside down or is otherwise inclined from a position in which the confined commodities rest on the bottom wall 15 of the container 14 or 14'.

Certain steps of converting the blank of FIG. 7 into the first section (carrier 12' and container 14') of the pack 10' are illustrated in FIGS. 8, 9 and 10. The blank of FIG. 7 has weakened portions in the form of fold lines 25, 39' and 46 to facilitate predictable folding in order to convert a first portion of the blank into the carrier 12', a second portion into the container 14' and a third portion into the tongue 50. The flaps 26 are folded at 28 relative to the respective inner panels 21'', 21''' and are adhesively or otherwise affixed to the inner sides of the adjoining panels 21 and 21'. This can be seen in FIG. 10. At such time, the outer panels 22'', 22''' are still coplanar with the respective inner panels 21'', 21'''. The carrier 12' and the portion 51 of the tongue 50 are thereupon pivoted relative to the outer panel 22' (see also FIG. 11a), and the making of the tongue 50 is completed by pivoting the portion 52 relative to the inner panel 21'. The adjacent surfaces of the portions 51, 52 of the tongue 50 and/or the adjacent surfaces of the panels 21', 22' may but need not be bonded and/or otherwise affixed to each other. Folding of the portion 51 and panel 22' relative to each other along the respective fold line 46 and of the portion 52 and panel 21' relative to each other along the front edge portion 23' can take place subsequent to introduction of commodities into the space which is bounded by the bottom wall 15 and the sidewalls 16—16''' of the container 14'. The carrier 12' is then pivoted along the weakened portion 39' and the panels 22'', 22''' are pivoted at 23'', 23''', respectively, to assume the positions which are shown in FIG. 12a. This completes the conversion of the blank of FIG. 7 into the structure which is shown in FIGS. 11a and 12a.

The making of a cover 30'' which is similar to the cover 30' of FIGS. 11b, 12b and 13b is shown in FIGS. 15 to 18. One starts with a semifinished cover 30''' which is illustrated in FIGS. 15 and 16. This semifinished cover is made of a thermoplastic material which preferably transmits light. The semifinished structure 30''' comprises a top wall 31, two relatively narrow parallel lateral walls 32 and two relatively wide lateral walls 32'. The only readily detectable difference between the covers 30' and 30'' is that the former has a top wall 15 with a substantially square and the latter has a top wall with a pronounced rectangular outline. The difference between the width of the lateral walls 32 and the width of the lateral walls 32' is shown at 60. The semifinished cover 30''' can be mass produced in a suitable injection molding or other available machine. The cover 30''' is then guided along heated rails or other supports (not shown) which contact the free edges of the wider lateral walls 32' so that the material of the lateral walls 32' becomes readily deformable. Portions of the lateral walls 32' are thereupon bent inwardly (as indicated by arrows 61 in FIG. 17) to form a cover 30' having a shape as shown in FIG. 18. Thus, each lateral wall 32' has an inwardly extending elongated projection 48 which may but need not be provided with a recess or notch of the type shown at 49 in FIG. 11b. The cover 30'' is then ready to be put to use in the same way as the cover 30', i.e., its projections 48 can be caused to releasably engage the outer panels 22'', 22''' of the respective sidewalls 16'' and 16''' (see FIGS. 12a and 14).

The exact composition of the preferably thermoplastic material of the covers 30, 30' and 30'' forms no part of the present invention. The same holds true for the material of the blanks which are shown in FIGS. 6 and 7. It is presently preferred to make the blanks of a suitable biodegradable material and to make the covers of a transparent or translucent plastic material.

An important advantage of the improved pack is its simplicity. Thus, the carrier (12 or 12') which is used to facilitate suspension of the finished product on a supporting rail or the like constitutes an integral part of the container for the commodities to be confined and displayed. Furthermore, it is possible to dispose of the major part (carrier plus container plus tongue, if provided) in an ecologically acceptable manner because all of these parts can be obtained by appropriate conversion of a one-piece blank consisting of cardboard or the like. Still further, the cover 30, 30' or 30'' need not be bonded to the container 14 or 14' which entails savings in connection with the making of the pack and renders it possible to repeatedly detach and reattach the cover. The coupling between the container 14 or 14' and the cover 30, 30' or 30'' is simple and inexpensive and enables the user to repeatedly gain access to and to again confine the commodities in the space between the bottom wall and the sidewalls of the container. Clear-cut separation of the cover from the container is desirable for several reasons. Thus, it is simpler to gain access to the confined commodities, and it is possible to fully separate the first and second materials in order to satisfy the rules and regulations by authorities in charge of regulating the disposal of waste products including empty packs for notions and the like.

The conversion of blanks into combinations of containers and carriers (and tongues, if necessary) can be automated, either entirely or in part. This contributes to lower cost of the making of long or short series of identical packs. The stability of the container 14 or 14' is highly satisfactory, especially if some or all of the sidewalls consist of several layers of cardboard or a similar shape-retaining material.

An additional advantage of the packs which are shown in the drawing is that the center of gravity of a finished and filled pack is located in or close to the plane of the carrier 12 or 12'. This renders it possible to suspend the pack on a rail or another suitable support in a predictable manner which contributes to the eye-pleasing appeal of the exhibited packs and renders it possible to accurately align two or more suspended packs in the longitudinal direction of the support for their carriers.

The improved pack can be furnished in any desired practical size and/or shape even though packs with square or rectangular containers and covers are preferred at this time.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A pack for notions comprising a first one-piece section of a biodegradable material and a second one-piece section of a non-biodegradable material said non-biodegradable material consisting of a light-transmitting plastic material, said first section comprising a container having an open top, a bottom wall, and sidewalls extending upwardly from said bottom wall and surrounding said open top, said first section further comprising a substantially plane carrier of one piece with said container said carrier extending substantially parallel to said bottom wall and having means for suspending said first section on a support, said carrier further having a front side and a rear side and said sidewalls extending beyond said front side, said second section comprising a cover separably confining at least a portion of said container, said cover comprising a top wall confronting said open top and lateral walls outwardly adjacent said sidewalls.

2. The pack of claim 1, wherein said sidewalls have front edge portions at said open top and said top wall is closely adjacent or abuts at least some of said front edge portions.

3. The pack of claim 1, wherein said sidewalls have front edge portions at said open top and at least one of said sidewalls comprising two overlying panels which are of one piece at the respective front edge portion.

4. The pack of claim 3, wherein said panels include an inner panel extending from said bottom wall to the respective front edge portion and an outer panel extending from the respective front edge portion toward but short of said bottom wall.

5. The pack of claim 1, wherein each of said sidewalls has an outer side and a front edge portion at said open top, at least one of said lateral walls extending from the front edge portion of the adjacent sidewall along the respective outer side toward but short of said bottom wall so that a portion of the outer side of said adjacent sidewall is exposed.

6. The pack of claim 1, wherein at least one of said sidewalls has a front edge portion at said open top and two overlying panels which are of one piece at said front edge portion, said panels including an inner panel extending from said bottom wall to said front edge portion and an outer panel extending from said front edge portion toward said bottom wall and having an edge spaced apart from said front edge portion, said outer panel being adjacent one of said lateral walls and said one lateral wall having a projection overlapping said edge to couple said cover to said container.

7. The pack of claim 6, wherein said projection is an inwardly bent portion of said one lateral wall.

8. The pack of claim 6, wherein said bottom wall and said top wall have a square or rectangular outline and said sidewalls and said lateral walls include two pairs of parallel sidewalls and two pairs of lateral walls, respectively, the sidewalls of one pair of sidewalls each having two overlying panels and the lateral walls of one pair of lateral walls each having a projection.

9. The pack of claim 8, wherein said projections are inwardly bent portions of the respective lateral walls, all of said lateral walls extending from said top wall toward but short of said bottom wall.

10. The pack of claim 6, wherein said projection constitutes a portion of said one lateral wall and is bent inwardly toward the adjacent sidewall as a result of the application of heat and/or pressure.

11. The pack of claim 6, wherein said one lateral wall extends a first distance from said top wall toward said bottom wall and at least one other lateral wall extends from said top wall toward said bottom wall a second distance less than said first distance.

12. The pack of claim 6, wherein said panels are of one piece along the front edge portion of said at least one sidewall and said outer panel exhibits a tendency to pivot away from said inner panel along said front edge portion, at least prior to confinement of said portion of said container in said cover.

13. The pack of claim 12, wherein said biodegradable material is at least slightly elastic so that said outer panel continues to exhibit a tendency to pivot away from said inner panel upon prolonged confinement of said portion of said container in said cover.

14. The pack of claim 6, wherein said first section is a converted blank of cardboard or like shape-retaining material and said front edge portion is a weakened portion of the blank.

15. The pack of claim 14, wherein said front edge portion includes a slit and at least one web of one piece with said panels.

16. The pack of claim 14, wherein said front edge portion includes two spaced apart elastic webs of one piece with said panels and an elongated slit between said webs.

17. The pack of claim 6, wherein said at least one sidewall has a weakened portion which is at least close to said front edge portion and is apt to be destroyed by said projection during extraction of said portion of said container from said cover.

18. The pack of claim 17, wherein said weakened portion coincides with said front edge portion.

19. The pack of claim 18, wherein said front edge portion has at least one elongated at least partially severed zone and at least one readily breakable web of one piece with said panels.

20. The pack of claim 18, wherein said front edge portion has two spaced apart narrow readily breakable webs of one piece with said panels and an elongated slit between said webs.

21. The pack of claim 1, wherein said lateral walls have edges outwardly adjacent said sidewalls and spaced apart from said top wall, at least one of said edges having at least one finger-receiving recess.

22. The pack of claim 1, wherein said sidewalls together form an enclosure for commodities at said bottom wall, said enclosure consisting of pairs of neighboring sidewalls and at least one sidewall of each pair having a flap which is overlapped by the other sidewall of the respective pair.

23. The pack of claim 22, wherein said flaps are of one piece with the respective sidewalls.

24. The pack of claim 22, wherein said sidewalls have front edge portions at said open top and each sidewall comprises an inner panel extending from said bottom wall to the respective front edge portion and an outer panel overlying the respective inner panel and extending from the respective front edge portion toward said bottom wall, said flaps being of one piece with the inner panels of the respective sidewalls.

25. The pack of claim 24, wherein each of said flaps is overlapped by the inner panel of the other sidewall of the respective pair of sidewalls.

26. The pack of claim 24, wherein said inner panel of said one sidewall of each of said pairs of sidewalls has two flaps.

27. The pack of claim 22, wherein each of said flaps is rigid with the other sidewall of the respective pair of sidewalls.

28. The pack of claim 27, wherein each of said flaps is bonded to the other sidewall of the respective pair of sidewalls.

29. The pack of claim 1, wherein said container further comprises at least one information-bearing tongue of one piece with one of said sidewalls and adjacent said top wall.

30. The pack of claim 29, wherein said tongue comprises two overlapping portions one of which is of one piece with said one sidewall and the other of which is of one piece with said one portion.

31. The pack of claim 30, wherein said one sidewall includes an inner panel of one piece with said bottom wall and an outer panel overlying said inner panel, said outer panel being disposed between and being of one piece with said other portion of said at least one tongue and with said carrier.

32. The pack of claim 31, wherein said tongue is substantially parallel to said bottom wall.

33. The pack of claim 1, wherein said container has a first width and said carrier has a second width which at least approximates said first width.

34. The pack of claim 33, wherein said sidewalls comprise pairs of overlying panels and have first thicknesses, said lateral walls having second thicknesses and said second width exceeding said first width by $2A+2B$ wherein A is the thickness of a sidewall and B is the thickness of a lateral wall.

35. The pack of claim 1, wherein said first section further comprises a weakened portion between said container and said carrier to permit predictable separation of said carrier from said container.

36. The pack of claim 35, wherein one of said sidewalls comprises an inner panel and an outer panel overlying said inner panel, said outer panel having a first elongated marginal portion of one piece with said inner panel and a second elongated marginal portion constituting said weakened portion.

37. The pack of claim 35, wherein said weakened portion includes a row of perforations.

38. The pack of claim 1, wherein said carrier is located in a plane between said top wall and said bottom wall.

39. The pack of claim 38, having a center of gravity in said plane.

40. The pack of claim 1, wherein said first section is a converted blank having a colored front side and a rear side, said bottom wall having a front surface confronting said top wall and forming part of said front side, said sidewalls having internal surfaces confronting each other and forming part of said front side, said sidewalls further having external surfaces and at least a portion of at least one of said external surfaces forming part of said front side, said carrier having a front surface forming part of said front side.

41. The pack of claim 40, further comprising at least one tongue of one piece with one of said sidewalls and adjacent said top wall, said at least one tongue having a front surface confronting said top wall and forming part of said front side.

42. The pack of claim 1, wherein said first section is a converted blank having a front side and a rear side, said bottom wall having a rear surface facing away from said top wall and forming part of said rear side, said carrier having front and rear surfaces forming part of said front and rear sides, respectively.

43. The pack of claim 42, wherein said sidewalls have internal and external surfaces, said external surfaces having first portions forming part of said front side and second portions forming part of said rear side.

44. The pack of claim 42, wherein at least one of said sides is colored.

* * * * *